United States Patent [19]

Lagain

[11] Patent Number: 4,798,573

[45] Date of Patent: Jan. 17, 1989

[54] MACHINE FOR THE MANUFACTURE AND STACKING OF BAGS, POUCHES AND THE LIKE MADE FROM A THERMOPLASTIC MATERIAL

[75] Inventor: Georges Lagain, Enghien-les-Bains, France

[73] Assignee: FMC Corporation, Chicago, Ill.

[21] Appl. No.: 39,055

[22] Filed: Apr. 16, 1987

[30] Foreign Application Priority Data

Apr. 18, 1986 [FR] France ..... 8605657

[51] Int. Cl.[4] ..... B31B 1/64

[52] U.S. Cl. ..... 493/204; 493/194; 493/199; 156/515

[58] Field of Search ..... 493/194, 199, 203, 204, 493/207, 209; 156/515

[56] References Cited

U.S. PATENT DOCUMENTS

| | | | |
|---|---|---|---|
| 3,810,420 | 5/1974 | Ravel . | |
| 4,230,029 | 10/1980 | Schott, Jr. . | |
| 4,518,378 | 5/1985 | Schulze et al. | 493/204 |
| 4,552,551 | 11/1985 | Dreckmann | 493/204 |

FOREIGN PATENT DOCUMENTS

| | | |
|---|---|---|
| 900020 | 6/1984 | Belgium . |
| 0002538 | 6/1979 | European Pat. Off. . |
| 0050339 | 4/1982 | European Pat. Off. . |
| 0056102 | 7/1982 | European Pat. Off. . |
| 0084880 | 8/1983 | European Pat. Off. . |
| 0090352 | 10/1983 | European Pat. Off. . |
| 0141718 | 5/1985 | European Pat. Off. . |
| 1930841 | 1/1970 | Fed. Rep. of Germany . |
| 2236524 | 2/1974 | Fed. Rep. of Germany . |
| 2358281 | 6/1975 | Fed. Rep. of Germany . |
| 3136619 | 3/1983 | Fed. Rep. of Germany . |
| 1388824 | 1/1965 | France . |
| 1485253 | 5/1967 | France . |
| 2031713 | 11/1970 | France . |
| 2150165 | 3/1973 | France . |
| 2519902 | 1/1982 | France . |
| 2566741 | 1/1986 | France . |
| 2026988 | 2/1980 | United Kingdom . |

*Primary Examiner*—Frederick R. Schmidt
*Assistant Examiner*—Robert Showalter
*Attorney, Agent, or Firm*—Raymond E. Parks; Douglas W. Rudy; Richard B. Megley

[57] ABSTRACT

A machine for the manufacture and stacking of bags, pouches and the like made from a sheath of a thermoplastic material in which an upper welding jaw and a belt driven horizontal cutting blade are slidably mounted to each other for vertical movement relative to each other and the lower welding jaw is also mounted for moving vertically and has a downstream projecting holding shoulder which has a horizontal transverse counter-blade-groove cooperating with the blade in a jaws lowered and closed position for cutting a portion of the sheath which is flexed between the shoulder and a clamp which presses an advanced segment of the sheath to a stacking table. The stacking table includes a vertically moveable pin carrier for impaling the severed end of a formed bag onto a transverse row of needles.

10 Claims, 10 Drawing Sheets

61
80
83
86
81
71b
85
84
82
57
61
62
71
67c
67b
67
67a
11
78
8
91
92
67b
89,90
54
53,87
56
9
18
7
17
6
13

MACHINE FOR THE MANUFACTURE AND STACKING OF BAGS, POUCHES AND THE LIKE MADE FROM A THERMOPLASTIC MATERIAL

This invention is related to the bag making machine disclosed in my United States patent application, Ser. No. 06/941,879, filed on Dec. 15, 1986, entitled Bottom Seal Bag Making Machine now U.S. Pat. No. 4,726,803, granted on Feb. 23, 1988, and claiming priority of my French patent application No. 86 00 027, filed on Jan. 1, 1986, and to a companion United States patent application Ser. No. 07/039,043 filed on this day together with this application and claiming priority of my French patent application No. 86 05 658, filed on Apr. 18, 1986, entitled A Cutting Apparatus For A Machine Used For Making Bags, Pouches And The Like From A Thermoplastic Material.

The present invention relates to a machine for the manufacture and stacking of bags, pouches and the like made from a sheath of thermoplastic material. The machine is of the type comprising a guiding path for transporting the sheath of a flattened thermoplastic material to a set of two intermittenly driven upper and lower transporting rollers between which the flattened sheath is tightly held during intermittent transport movement thereby. The lower roller of which is mounted in a fixed in place manner and the upper roller of which is mounted for vertical movement so that it can move vertically away from the fixed in place lower roller under the action of a first governing member. A set of upper and lower welding jaws are positioned on opposite sides of the intermittent trajectory path of the sheath moving downstream from the two transporting rollers, at least one of two welding jaws is vertically movable perpendicularly to the trajectory path so that it can approach and move away from the other welding jaw. A transverse sheath cutting device is provided downstream from the welding jaws and comprises an upper knife or blade and a lower counter-blade, as well as a device for the intermittent stopping of the sheath. The stopping device is provided upstream from the two welding jaws, and upstream from the transporting roller means and comprises a movable upper support show which is activated by the first governing member, and a fixed in place lower counter-shoe.

A machine of above type has been described in my French Pat. No. 1 388 824 granted on Jan. 4, 1965 and it presents, especially, the drawback of not permitting high manufacturing rhythms for the thermoplastic bags, and of not comprising any device for the stacking of the bags after they have been welded and the sheath has been cut.

One objective of the present invention is to provide a stacking device for the bags downstream from the welding jaws and is of the type which presents a movable lower stacking table, movable relative to the lower jaw and capable of receiving between its upper upstream end and the lower face of a retaining shoulder of the lower jaw, the upstream end of the bags which have been cut and stacked. Another objective is to provide an upper blocking shoe which is vertically movable and capable of coming to block the extreme part of the sheath which projects beyond the cutting device, against the stacking table. The shoe is positioned downstream from the jaws and downstream from the welded and cut end of the immediate following bag in process of manufacture. According to a known mode of operation of the stacking device, after the cutting the last cut bag, which rests on the stack of bags and the stacking table, the stack of bags are moved downward under the action of the blocking shoe, or the lower jaw is slightly raised in order to separate the stack from the retaining shoulder and in order to permit the rear or upstream end of the cut bag to be flattened and to place itself on the pile of bags where it will be maintained, for example, as soon as the blockign shoe goes back up and the lower jaw moves down, thus making possible, under the action of a return spring, the rising again of the table and the tightening of the rear end of the pile of bags between the table and the retaining shoulder of the lower welding jaw. Such a stacking device is known, for example, through German Pat. No. 19 30 841 granted on Dec. 23, 1976 and presents the drawback of leaving between the support zone of the blocking shoe and the point at which the sheath is cut, or the upstream end of the first bag, a critical distance so that the upward portion of bag to be folded back on the pile of bags presents a relatively critical length and that the time necessary for the layering of that portion becomes too long and that a rapid layering requires the use of slowing means or of other additional means.

Indeed, the progress achieved recently in the field of extrusion of thermoplastic sheaths makes it possible for those sheaths to have walls which are thinner and thinner or fine and, consequently, have less and less "memory or springy quality" to return to their initial position after they have been partially separated or moved away from it. That phenomenon explains the fact that bags made from said fine sheaths fold back very slowly or insufficiently toward the pile of bags after the cutting of their rear end. That drawback is not eliminated in spite of the use of a blowing nozzle carried by the blocking shoe which blows a layer of air in the direction of the lower face of the holding back shoulder. There follows that, that the type of stacking devices for bags which is known for example through the aforementioned German Patent Application DT 19 30 841, does not permit the manufacture of the thermoplastic bags at a high frequency. In addition, the fact of almost permanently tightening the stacked bags, which are resting on the stacking table, causes the end of a bag which may be incorrectly deposited thereon, a permanent crease which later on hinders the opening of such bag.

Instead of using a layer of blown air to favor the layering of the upstream end of a bag, it is also possible to make use of an additional application member, as has been suggested by European patent application No. 0 050 339 and No. 0 084 880. In both cases the portion of the sheath which is pinched between, for one part, the transporting rollers and for the other part, the stacking table and the blocking shoe, is placed under tension either through an additional lowering of the table stack of bags clamped by the blocking shoe shown in European patent application No. 0 050 339, or by means of the vertically movable pressure bar member provided for above the sheath between the knife blade and the blocking shoe shown in European patent application No. 0 084 880. In both cases, the different elements or members to be set into motion and to stop in different precise positions make it mandatory to respect relatively low manufacturing frequencies and they lead to jerks in tension on relatively short portions of sheath, something which may bring about uncontrollable bag elongations.

In order to prevent the formation of wrinkles at the upstream end of the cut bags, and in order not to tighten their ends between the lower face of the retaining shoulder of the lower welding jaw and the stacking table, it has already been suggested to impale the upstream ends of the cut bags over a row of transverse needles or stacking pins, placed downstream and in the proximity of the lower counter-blade of the cutting device. In accordance with the known structure of the European patent application No. 0 084 880, the stacking table carries at its upstream end a counter-blade member of the cutting device which is located at a certain distance above the support face of the stacking table and slightly forward from the upstream end so as to form a lodging for the upstream ends of the stacked bags. The row of vertical needles or pins is mounted vertically movable to permit the release of the pins after the completion of a predetermined number of stacked bags and it is further placed downstream and in the immediate proximity of the counter-blade member. In this arrangement, a horizontal leg of the pressure bar member is provided with a row of vertical holes in vertical alignment with the row of vertical needles or pins and after each cutting of a bag, the horizontal leg folds back the upstream end of the formed bag and fits the cut upstream end over the needles or pins. The stacking table having a fixed position,the pressure bar member or pin fitting member performs an important run at the beginning of each cycle of stacking of the bags, which run progressively decreases until there is reached a minimum run at the end of a stacking cycle. Those runs, however are relatively important, because the fitting member must, after each fitting run, come back to a position located above the trajectory of the sheath and in addition the distance between the counter-blade member and the support face of the table for the stacking of the bags must be important enough to also permit the upstream end of the upper bag of the stack of bags to be correctly folded back. Another drawback of that known stacking device resides in the use of two movable members, i.e., the blocking shoe and the pressure bar member which are located above the trajectory of the sheath and which perform important intermittent runs.

The present invention has as an object, to provide a machine for the manufacture and stacking of thermoplastic bags, of the previously described type and comprising a stacking device ofthe aforementioned type, a machine which makes it possible to reach very high manufacturing frequencies, even with thin thermoplastic sheaths, and without any deformation of the upstream ends of the stacked bags.

In a machine of that type, the purpose of the present invention is achieved because:

(a) The upper welding jaw is driven by the blocking shoe, with interposition of a return spring which enables it also to move with respect to the blocking shoe under the action of the lower welding jaw;

(b) the lower welding jaw is movable and is provided on a downstream vertical face above the lower face of the retaining shoulder with a transverse horizontal groove that is open at both of the lateral sides of the shoulder and in the downstream vertical face. One of the edges of the shoulder serves as a counter-blade for the cutting device;

(c) a part of the blocking shoe is placed below the trajectory of the movable knife or blade of the cutting device in a manner such that the vertical trajectory of its upstream vertical face will pass with a small play only in front the vertical downstream face and before the horizontal counter-blade groove provided for in the lower jaw;

(d) the upstream end of the stacking table presents a horizontal support plate placed partially out of plumb relative to a transverse support bar member and below the retaining shoulder, and is provided below the retaining shoulder with a row of transversely extending vertical holes;

(e) a row of transversely extending vertical needles or pins is placed in vertical alignment with the row of vertical holes, in a manner such that the needles or pins pass through the holes, the row of needles or pins being mounted on a needle or pin carrier installed below the retaining shoulder, with a fixed position during the bag stacking operation, between the support bar member and the lower welding jaw the vertical movement of which is limited to a distance slightly greater than the length of the free upstream end part of a cut bag, located between the upstream end and the zone of the bag which is tensioned between the stacking table and the blocking shoe, the distance being determined between a high position and a low position of the table in which the retaining shoulder rests on the tips of the needles or pins without exerting any pressure on the pile of cut bags; and that (f) the stacking table is made movable independent of the movement of the needle or pin carrier by means of a stopping mechanism which permits a progressive downward motion of the table as the height of the stack of bags thereon increases, and which prevents any upward motion of the latter as soon as its ascending run exceeds the step between the two neighboring notches of said mechanism.

Because of that design, the number of members which execute intermittent back and forth motions with an important run is limited as compared to the solutions proposed by the prior art. In addition, the free upstream end of a cut bag presents a very small length and it rapidly folds back on its own over the disengaged needle or pin points. The retaining shoulder on the lower welding jaw here fulfills a new impaling function by impaling the bags over the needles or pins while making only a very short run and without compressing or tensioning the upstream end of the stacked bags. The needle or pin points are always protected underneath the shoulder and they cannot interfere in the trajectory of the sheath. In addition, the blocking shoe always covers the same run of constant length.

Other characteristics and advantages of the present invention will be seen in the following description of an exemplary embodiment of the invention to be read in connection with the various figures in the drawing here attached, in which.

Figure 2:
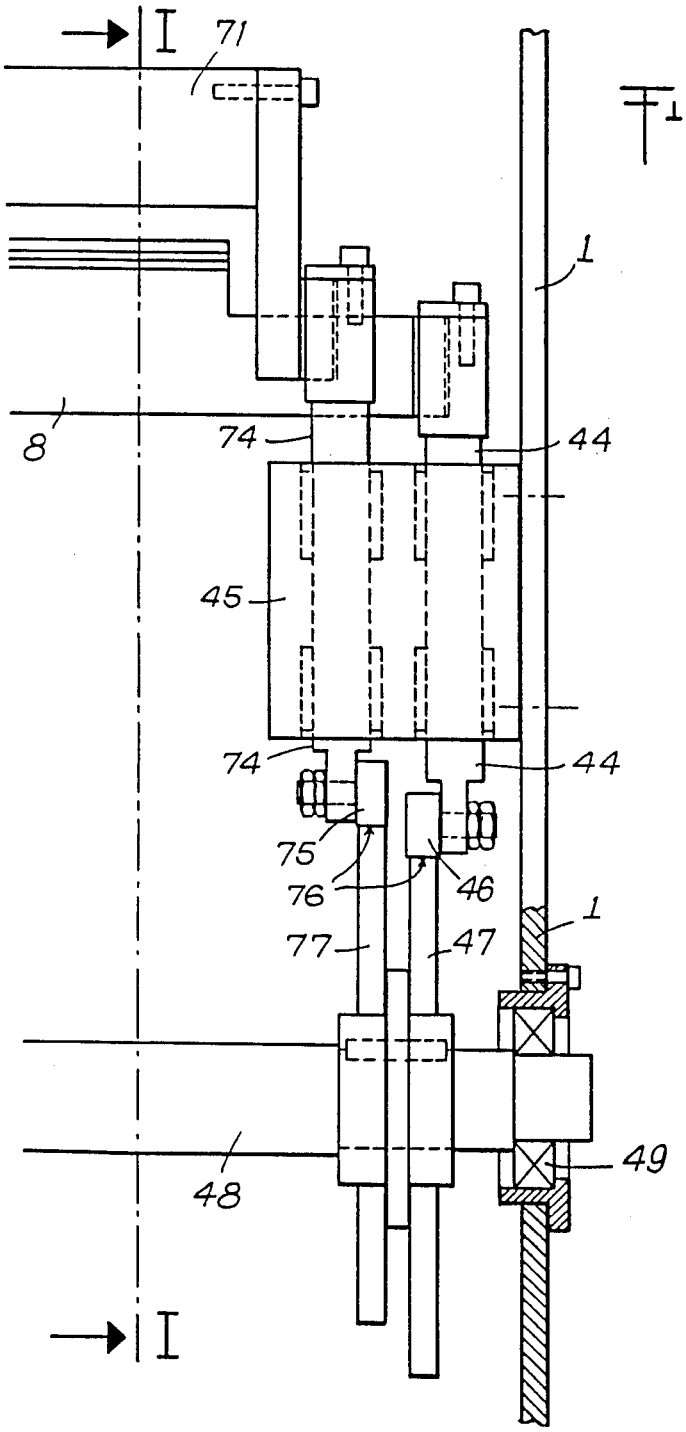
FIG. 2 is a front view of the left side of the machine, taken in the direction of passage of the sheath.
Figure 6:
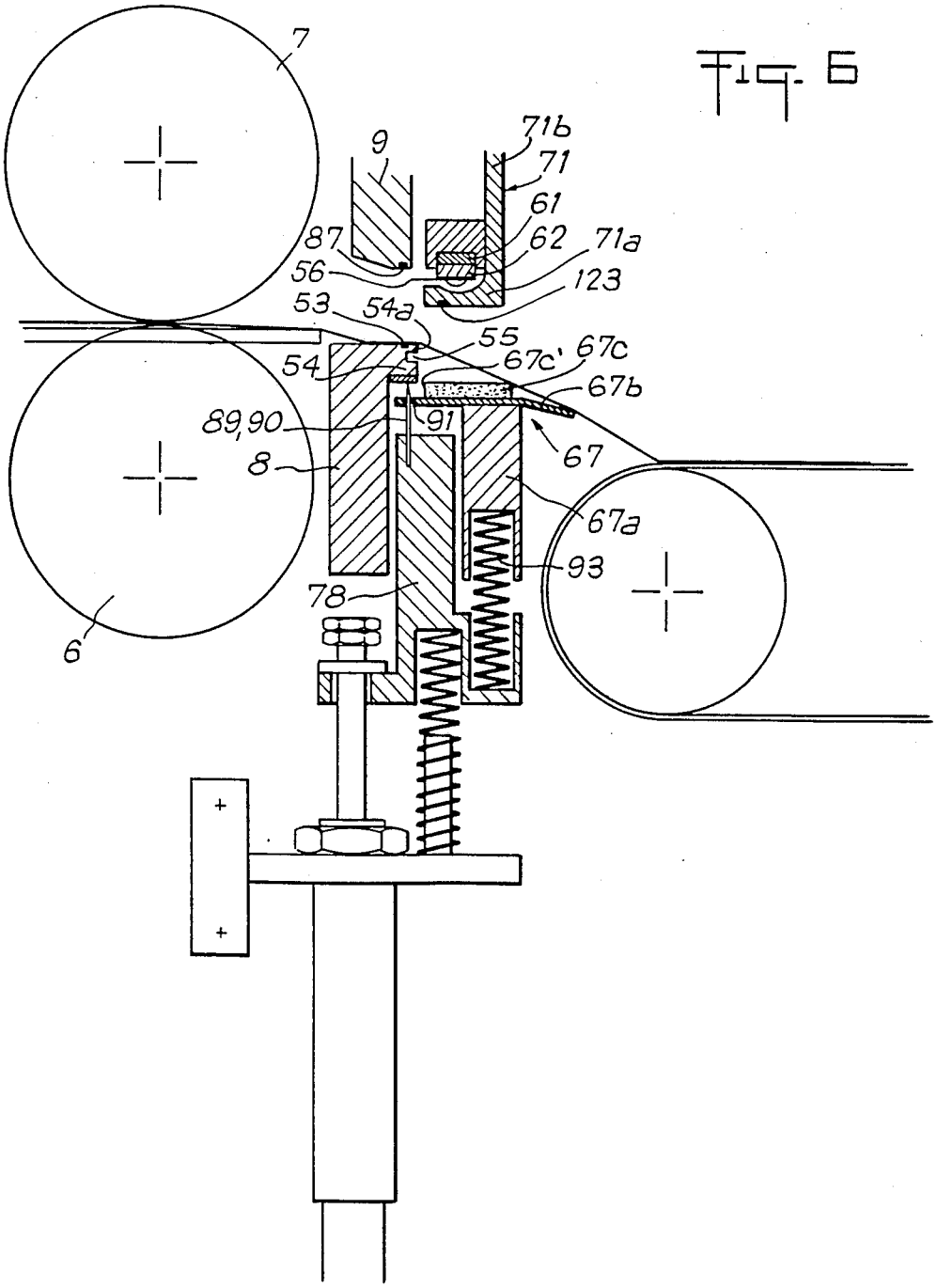
FIGS. 6 to 8 are schematic views, in elevation, of longitudinal sections showing more especially the different positions of the lower welding jaw, of the needle or pin carrier and of the stacking table including certain governing members of the needle-carrier and of the stacking table, during the manufacturing and the transportation of a completed stack of bags.
Figure 8:
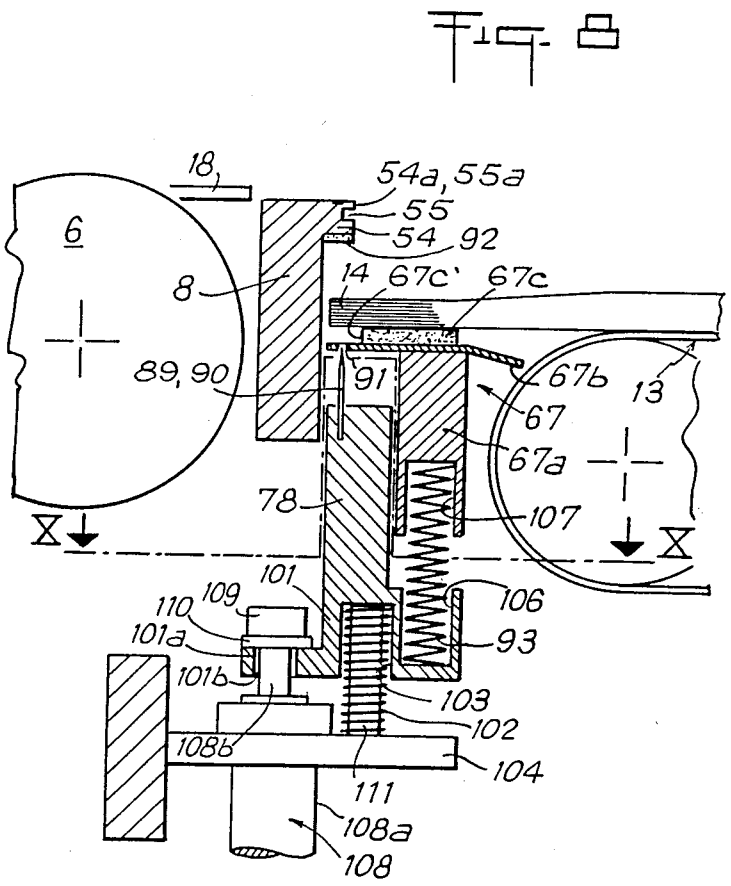
Figure 9:
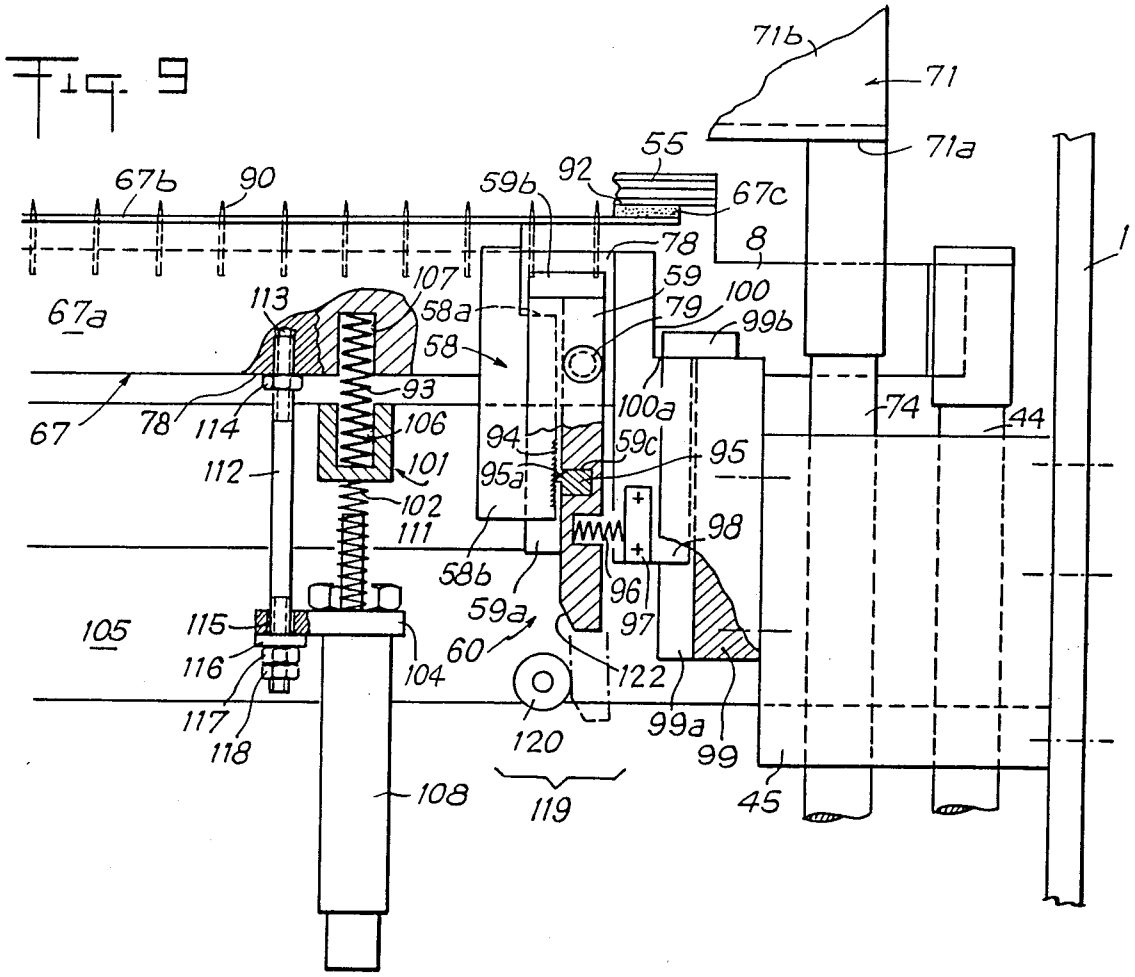
Figure 10:
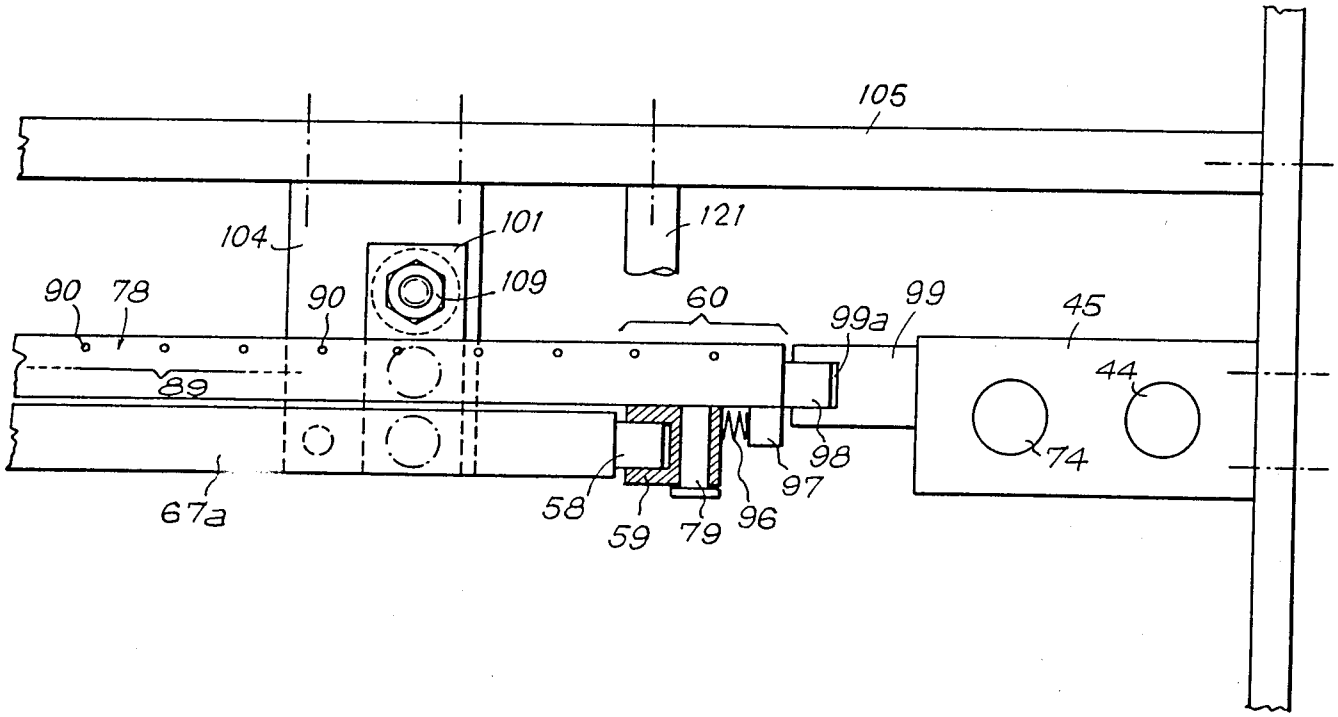

FIG. 9 is similar to FIG. 2 and is a partial elevated frontal view looking upstream of the stacking table, of the needle or pin carrier and of the lower welding jaw, and corresponding to the position of the various elements shown in FIG. 6; and FIG. 10 is a partial plane view of the needle or pin carrier and of a part of the stacking table, along the horizontal planes of the dash-dot line X—X in FIG. 8.

Figure 1:
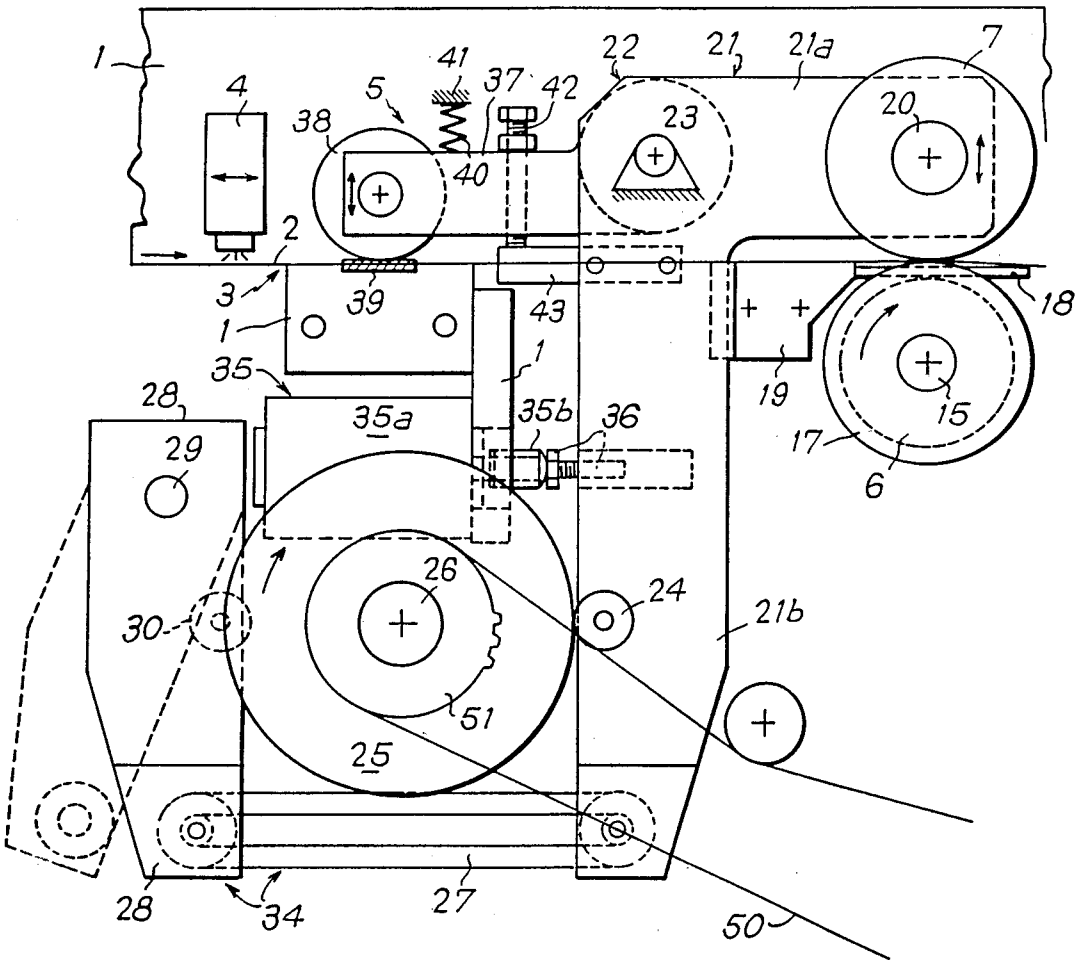
FIG. 1 is a schematic elevated view of a vertical longitudinal section through a part of the machine which essentially is located upstream from the welding jaws, along line I—I in FIG. 2A.

With reference to FIG. 1 of the drawing, the machine for the manufacture and the stacking of thermoplastic bags, generally comprises a frame having lateral side plates 1. A thermoplastic sheath 2 is unwound from a storage spool, not shown, which moves in a flattened state along a guiding path 3 extending horizontally through the upper portion of the machine. Along the trajectory of the sheath on the guiding path there are provided for, from the frontal upstream end to rearward downstream end, a photoelectric cell 4 arranged to detect the length markings on sheath 2 and to start the activation of a governing member, an intermittent stopping device 5 for intermittenly stopping the travel of the sheath 2 downstream to two cooperating transporting roller means 6, 7, for moving the sheath 2 forward by a given length to two cooperating welding jaw means 8, 9 (FIG. 3) for welding or sealing together the two opposite horizontal facing surfaces of the flattened sheath 2 along a transverse extending weld line and, preferably, perpendicular to the longitudinal extending sides of the flattened sheath 2, a transverse extending cutting device means 10 for cutting the sheath 2 downstream and in the immediate proximity of the welding joint made by the jaw means 8, 9, a stacking device means 11 for stacking the welded and cut bags 12 thereon, and a transporting belt means 13 for transporting a completed stack 14 (FIG. 8) of bags from the stacking table means 11 to an accumulating area.

The lower transporting roller 6 is fastened with means, such as a cotter pin, to a driving shaft 15, the ends of which are fitted in bearings, not shown, fixed in place to frame 1. The shaft 15 is connected to a continuous driving motor, not shown, through a speed variation device, also not shown. The lower roller 6 has a series of annular grooves 17 for receiving and providing clearance to a plurality of blowing tubes 18 extending horizontally at the upper part of lower roller 6 below the horizontal underside of the sheath 2, and which extends downstream and terminates in close proximity to the upstream facing vertical faces of jaws 8, 9. These blowing tubes 18 are intended to produce a first layer of air below the sheath 2, and to prevent the sheath from becoming stuck to the lower welding jaw 8. In addition, the first air layer serves to support and to propel the cut end of sheath 2 from the jaws 8, 9 and beyond the transverse cutting device 10. The upstream ends of the blowing tubes 18 are carried by an air distributor 19 fixed in place to frame 1.

The upper transporting roller 7 is fastened by means, such as a cotter pin, to a support shaft 20 mounted to a free end of rock arm lever 21 which extends downstream from the elbow 22, which is mounted for pivoting around a pivot shaft 23 fixed in place to the frame 1. The horizontal arm **21*a* of the double arm rock lever 21 carries the support shaft 20 for the upper roller 7, while the depending vertical arm 21*b* of the double arm lever 21 carries in close proximity to the lower free end, a small disk or roller 24 which cooperates with a cam 25 which constitutes, for the upper roller 7, a first governing member, and which is fastened with means, such as a cotter pin, to a control drive shaft 26 continuously rotating at a constant speed but which is adjustable. The shaft 26 is fastened in place to frame 1**.

The lower end of the depending vertical rock arm **21*b* of the double arm crank lever 21 is connected to a return tension spring 27, the other end of which is hooked to the lower end of a simple lever arm 28, the upper end of which pivots around a pivot shaft 29, fixed in place to the frame 1 and parallel to the pivot shaft or axis 23 at the elbow 22 of the double arm lever 21 and parallel to the axis of the drive shaft 26**.

Figure 2A:
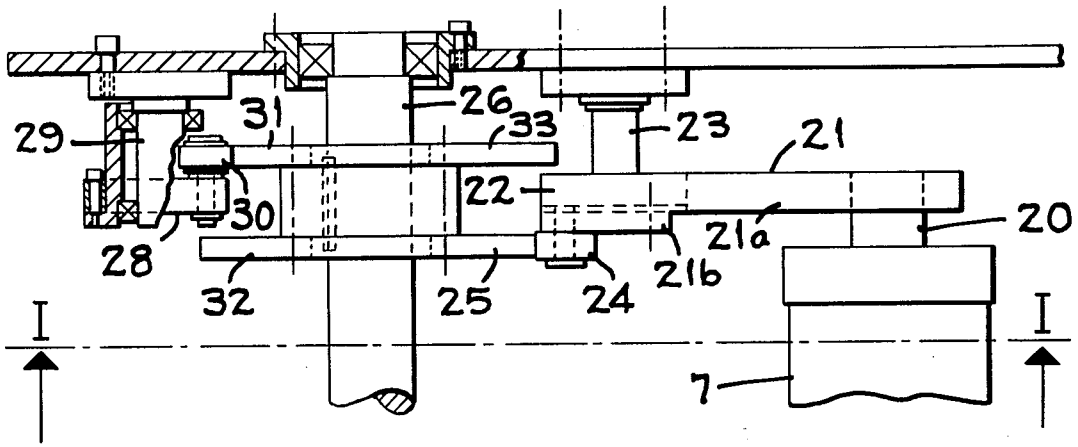
FIG. 2A is a front view of the machine taken upstream of the welding jaws.

The median portion of the simple lever 28 carries a small contact disk or roller 30 which cooperates with a second cam 31 (FIG. 2A), also fastened with means, such as a cotter pin, on the governing or drive shaft 26 of the first cam 25. These two cams 25 and 31 have driving surfaces 32, 33 which are angularly oriented relative to each other, in such a manner that the simple lever arm 28 is urged in a clockwise direction around the pivot shaft 29, in a manner such as to have a maximum angular position, as shown by the broken line in FIG. 1, relative to the holding or rest position and to stretch to a maximum length the return or tension spring 27, every time the upper roller 7 is to be applied with maximum force against sheath 2 and the lower roller 6 at the time of start of a new transporting step of said sheath 2, and that the simple lever arm 28 then is capable, at the end of a one step forward motion of sheath 2, to come back to the rest position in which the tension spring 27 exerts only a minimum force on double arm lever 21 and, consequently, on upper roller 7, and that exactly at the end of the one step forward motion of sheath 2, the first governing cam 25 will cause to pivot, rapidly and without any appreciable effort, the vertical arm **21*b* of double arm lever 21 in a counterclockwise direction for the purpose of very slightly moving upper roller 7 away from the nip of lower roller 6**.

The precision of timing the spacing of upper roller 7 can further be improved in combination with a variation device 35 for application of force to the upper roller 7. The variation device 35 which is used to accomplish this purpose comprises a rapid action member such as an electromagnet coil **35*a* which is fixed in place to frame 1 and a movable iron core 35*b* which acts on an adjustable lug piece 36 carried, by the vertical arm 21*b* of the double arm lever 21**.

It is obvious that the action of the electromagnet means 35 on the doublee arm lever 21, in the counterclockwise direction for spacing the upper roller 7 from the lower roller 6, may be started by the photoelectric cell 4 mounted in an adjustable manner on the trajectory path of sheath 2, instantaneously spacing the upper roller 7 maintaining the spacing by the corresponding governing camming surface 32 of the first cam 25. It is obvious that the form of the governing or camming surface 32 of the first cam 25 must be such that the upper roller 7 again can be lowered to nip the sheath 2 between the lower roller 6 at the start of a new one step forward motion step and until the end of same.

So as to be able to ensure the precise stopping of the sheath 2 at the end of each one step forward motion step, the machine is also equipped with an intermittent stopping means 5 which comprises a simple lever arm 37 having a downstream projecting end which is pivotally mounted to the pivot shaft 20 carried on the terminal end of the horizontal rock arm 21 of double arm lever 21. The upstream end of lever 37 carries an upper braking means, such as a braking roller 38 positioned above a braking shoe 39 which is placed below the trajectory path of the sheath 2 and is fixed in place to frame 1. The braking roller 38 is continuously urged in direction of the brake shoe 39 by means of a compression spring 40 bearing, for one part, against the upper face of the simple lever arm 37 and bearing, for the other part, against an adjustable lug piece 41 fixed in place to the frame 1.

In order for the braking roller 38 to be spaced from the sheath 2 and from the brake shoe 39, the simple lever arm 37 of the braking device 5 comprises an adjustment screw 42 the end of which abuts against a lug piece rod 43 which extends below the fore part of the simple lever arm 37, and is fixed to the vertical arm **21*b* of the double arm lever 21. Thus, when the upper transporting roller 7 is spaced and made to pivot upward from the lower roller 6, the braking roller 38 immediately can drop and come in contact with and the press the sheath 2 against the brake shoe 39, and thus instantly stop any undesired displacement of the sheath 2. The degree of forward motion of the spacing of braking roller 38 relative to a new application of the upper transporting roller 7, can be adjusted by means of the regulating screw 42**.

Immediately downstream, as shown in FIGS. 3 to 8, from the pair of transporting rollers 6, 7, there is provided two cooperating welding jaws 8, 9. The lower jaw 8 is vertically movable over a short distance and the upper jaw 9 is vertically movable over a greater distance. The vertical raising and lowering displacements of the lower jaw 8 are governed by means of a pair of vertical guiding rods 44, only one of which is shown in FIGS. 2, 9 and 10, which are fixed at their upper end to the lateral sides of the lower jaw 8. These guiding rods 44 are mounted in a sliding manner inside a guiding casing 45 which is affixed to the frame 1, and which extends over part of the length of the rods 44 in a manner such as to enablee them to perform their maximum run between a low jaws open position shown in FIGS. 3 and 6 and the welding low jaws closed position shown in FIGS. 4 and 7 a high jaws closed position shown in FIG. 5, where the upstream end of the immediate or last cut bag has a portion compressed against the stacking table 67, or against one or more bags accumulated in a stack 14 (FIG. 7) on the stacking table 67, and the sloped cut terminal end portion 88 flips or folds back to a horizontal position above the transversely extending row of pins 90.

As shown in FIG. 2, the governing rods 44 carry a contact roller or small disk 46 on their lower terminal ends, which bears against the governing face of a third cam 47 fastened by means, such as a cotter pin, to the opposite ends of a driven shaft 48 which is mounted, by means of bearings 49, on frame 1, and which is continuously driven from the governing shaft 26, (FIG. 1) through the power transmission chain belt 50 and sprocket gear wheel 51, one of which is fastened, such as by a cotter pin, to shaft 26 and the other (not shown) to the driven shaft 48.

At its upper part and downstream from its welding line or zone 53, (FIGS. 3, 4 and 6) the lower jaw 8 presents a projecting retaining shoulder 54 directly downstream and having a horizontal transverse groove 55 in the downstream facing vertical face **54*a* which opens out in both lateral sides of the shoulder 54, and extends perpendicular to the longitudinal edges of the tubular web 2 and in a direction parallel with the horizontal cutting trajectory of the upper cutting blade 56 of a cutting device means 10. The transverse groove 55 acts as a counter-blade by means of the upper frontal edge 55*a* for the cutting blade 56, which can enter into the groove 55 from one open end of the groove and rapidly pass through the other open end of the groove thereby cutting the tubular web 2 along the transverse length of the groove. The cut end segment 88 of the immediate cut bag is cut very close to the horizontal lower face of the retaining shoulder 54 on the lower welding jaw 8**.

Figure 4:
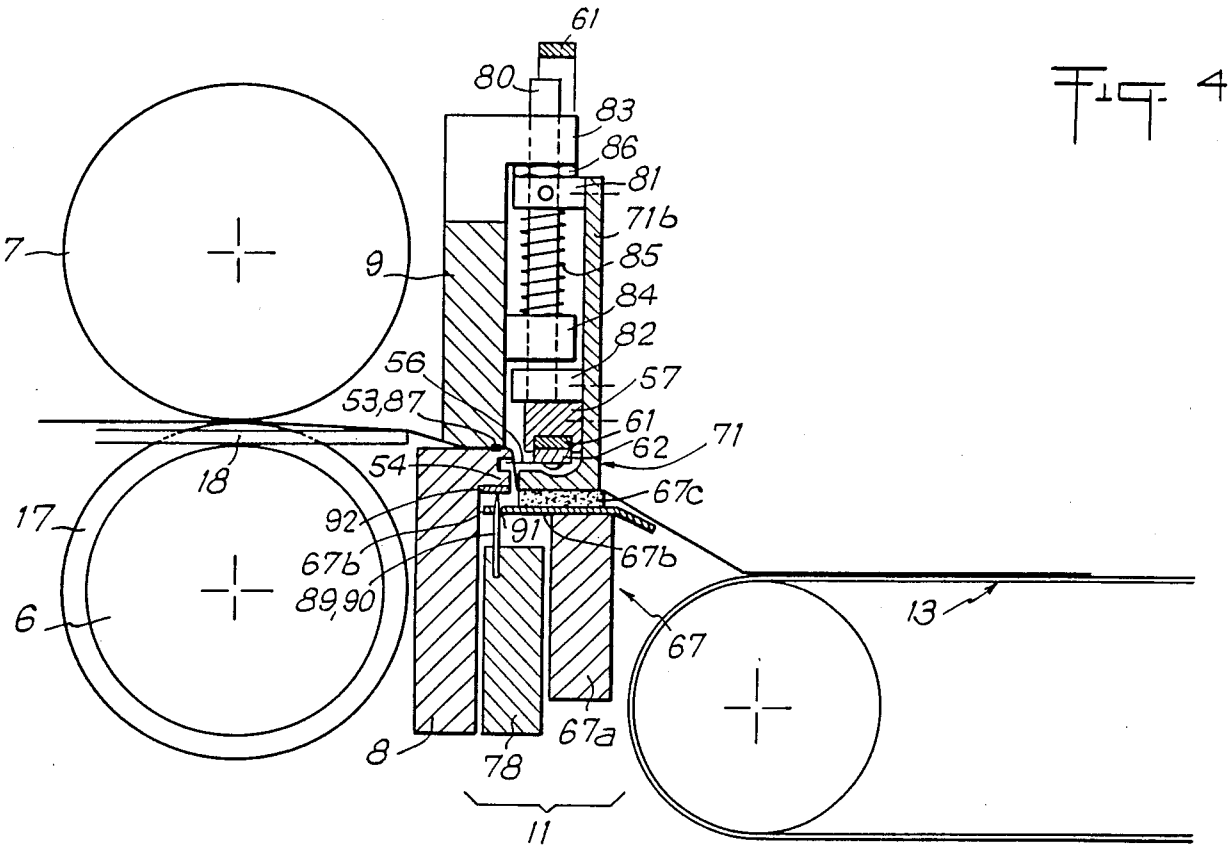

It must be noted that the vertical upstream facing side **54*a* of the retaining shoulder 54 serves at least partially, during the cutting operation of sheath 2, as a support plane for the end to be cut as shown in detail in FIG. 4. This arrangement is greatly advantageous for a rapid cutting of sheath 2 and for the horizontal flattening of the upstream end 88** of the bag which has just been cut.

The cutting device 10, shown in FIGS. 3–7, is mounted downstream and in the immediate proximity of the upper jaw 9 and comprises a pair of timing belt drive and return pulleys, (not shown), around which runs an endless timing support belt 61. At least one of the two sides of the belt, preferably the lower side, is guided in a horizontal transverse direction parallel to the horizontal transverse groove 55 in the shoulder 54 on the lower jaw 8, by means of a small transverse guiding channel or grooved bar 57. The depending legs of the channel or grooved bar 57 define a horizontal guiding channel **57*a* in which moves the lower side of the timing belt 61. The timing belt 61, as shown in FIGS. 4–7, has at least one horizontal fixation tab 62 for attaching the knife 56 to the external smooth side of the belt. The blade extends from the tab 62 horizontally in an upstream direction so as to readily enter the groove 55 of the counter-blade and in a plane perpendicular to the sloped support plane of the upstream end 88 of sheath 2 tensioned between the edge of the shoulder 54 and the blocking shoe 71. The support plane starts at the upper edge 55*a* of the shoulder 54 above the transverse groove 55 of cutting device 10 and extends to the lower upstream facing edge of the blocking shoe 71**.

One of the splined pulleys is continuously driven by an adjustable speed motor (not shown) which is synchronized with the displacements of the lower and upper welding jaws 8, 9 in a manner such that the cutting blade 56 will begin its horizontal trajectory along the lower side of the timing belt 61 only when the welding jaws 8, 9 clamp the sheath therebetween and the jaws are in the low position of welding shown in FIG. 4. The lower smooth side of the timing belt 61 is guided in the guide **57*a* affixed to blocking shoe 71. The general design of the cutting device 10**, is described in U.S. Pat. No. 4 230 029, to which reference may be made for further detail, and in my aforementioned French patent application No. 86 05 658 and the corresponding United States patent application, Ser. No. 07/039,043.

It is to be noted in FIG. 5 that the lower jaw 8, immediately below the transverse groove 56, is provided with a certain number of apertures 63 for blowing air, which extend horizontally in the direction of passage of the sheath 2 and which open on the vertical downstream facing fac 54*a* or on the bottom of the horizontal groove 55 in the retaining shoulder 54. The blowing apertures 63 are connected to vertical feeding ducts 64 provided for inside the body of the lower jaw 8 and are connected to a source of air under pressure (not shown).

Inside of those feeding ducts 64, there are provided open horizontal transverse ducts 65 connected to the atmosphere on the downstream facing vertical face 66 of the lower jaw 8 below the retaining shoulder 54. The transverse ducts 65 suck in hot outside air toward the blowing apertures 63 by means of a water-jet pump effect. These blowing apertures 63 serve to create a second sheet of support and transportation air immediately downstream from the lower jaw 8 above the stacking table 67 and below the tubular web 2. The second sheet of air is either permanently or intermittently established.

Below and downstream from the retaining shoulder 54 of lower welding jaw 8, there is provided for a stacking device 11 shown in FIGS. 6–8, comprising a stacking table 67 which is mounted on a cross beam 67*a* which is vertically biased upwardly by a compression spring 93. A support plate 67*b* is fixed to the cross beam 67*a* and has an upstream side which extends horizontally below the retaining shoulder 54 and a downstream side which is sloped or bent downwardly toward an endless transport belt conveyor 13.

The upper face of the stacking table 67 below the blocking shoe 71 is provided with an elastic cushion or pad 67*c*, of rubber or elastomeric material for example, serving to dampen the contact shock between the table 67 and the blocking shoe 71 in the low welding position of the jaws 8, 9. The upstream facing vertical face 67*c*' of the pad 67*c* terminates in very close proximity to the vertical plane passing through the downstream facing vertical face 54*a* of the retaining shoulder 54 on the lower jaw 8. The stacking table 67 is mounted for vertical movement over a run height which is slightly greater than the maximum height of a pile of welded and cut bags 14 stacked thereon. To accomplish this maximum run height the lateral ends of the cross beam 67*a*, as shown in FIGS. 9 and 10, are fitted with sliders 58 vertically movable inside a pivotably mounted guide 59, the upper end of which is articulated on the upstream facing vertical face of the needle or pin carrier 78 by means of a horizontal pivot pin 79 which is connected perpendicular to upstream facing vertical face of the needle or pin carrier 78. Each lateral slider 58 and its pivotable guide 59 are associated with a ratchet type of a stopping mechanism 60 having a pawl 95 on the guide 59 and a catch 95*a* on the slider 58, which permits progressive downward movement, step-by-step, of table 67, and which prevents any upward movement of the sliders 58 and table 67. As soon as the descending run of the table 67 exceeds the step between two notches on the catch 95*a* of the stopping mechanism 60, during the stacking of cut and welded bags 14, the stopping mechanism 60 then fixes the needle or pin carrier 78 in place between the lower jaw 8 and the cross beam support 67*a* of the stacking table 67.

The stacking device 11 further comprises the blocking shoe 71, which is vertically movable and capable of passing in close proximity to the downstream facing vertical face 54*a* of the shoulder 54, and of pressing against the upper face of the resilient damper pad 67*c* carried on the stacking table 67 and of blocking, in that way, the upstream end portion of the bottom sealed sheath 2 to be cut against the damper pad 67*c* on the table 67 in close proximity to the cutting device 10 and the transverse groove 55 of shoulder 54. The bottom sealed end portion of the sheath 2 to be cut, which is downstream of the blocking shoe 71 rests on the stack 14 already supported, for the most part, on top of the endless transporting belt 13 (FIG. 8).

Figure 3:
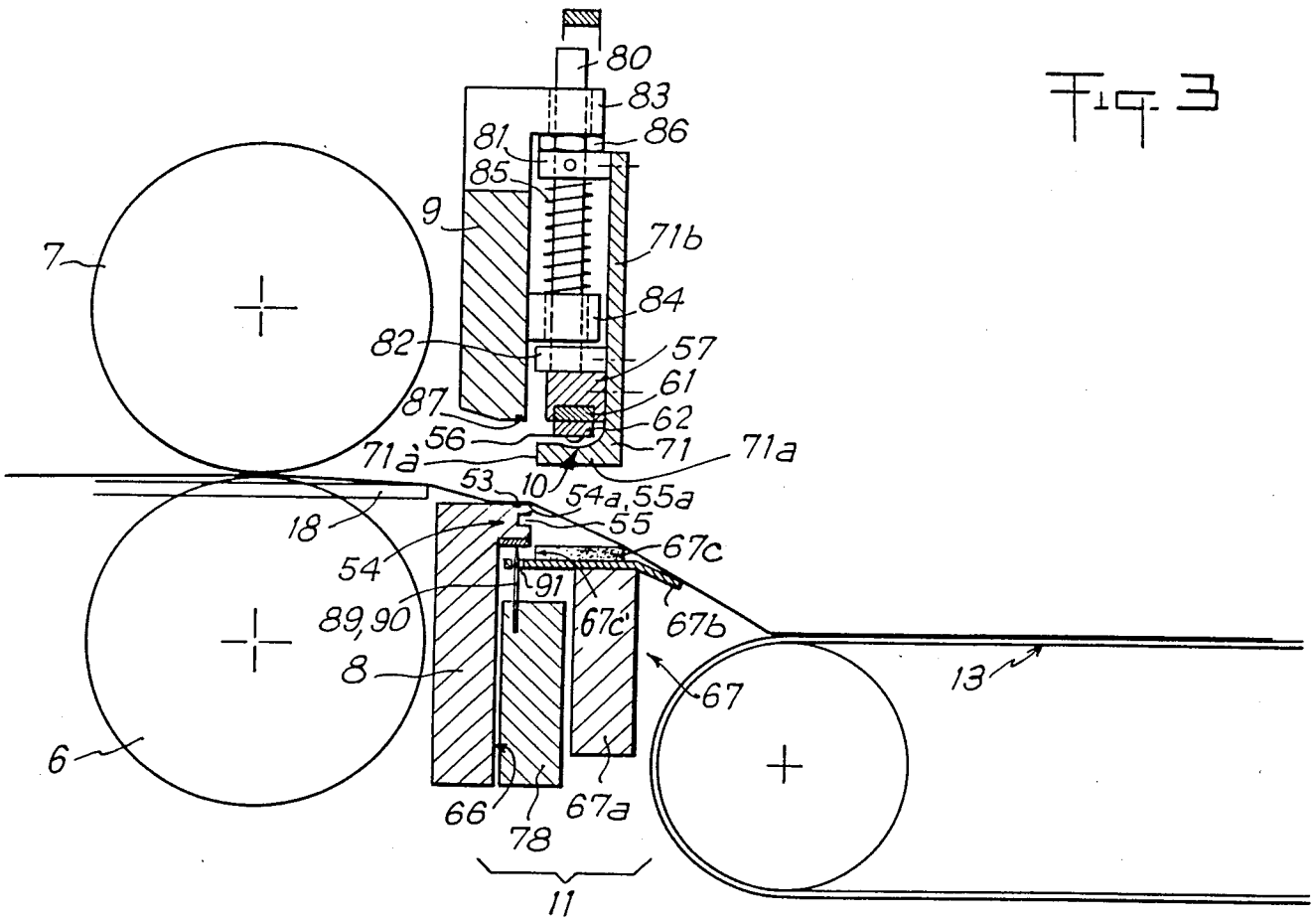
FIGS. 3 to 5 are schematic views, in elevation, of vertical longitudinal sections of the downstream part of the machine starting from the two transporting rollers, those figures illustrating different work positions of the welding jaws, of the cutting device, of the blocking shoe and of the stacking table taken along I—I in FIG. 2.

In a manner similar to the system governing the vertical displacement of the lower jaw 8, the maximum vertical run of the lower jaw is slightly greater than the vertical distance between the underside of the retaining shoulder 54 and the horizontal upper side of the cutting groove 55 in the shoulder 54. An upstream portion spaced from the cut end of the last bag cut is pressed by the blocking shoe 71 either against one or more bags 14 on the stacking table 67 or against the damper pad 67*c* on the stacking table 67, if the last cut bag is the first of the cut bags to be stacked on the pad of the stacking table 67. The blocking shoe 71 is fixed, at its lateral ends, to the upper end of two vertical support and guiding rods 74 (FIGS. 2, 9 and 10) mounted in a sliding manner in the same guiding box 45 as the guiding rods 44 of lower welding jaw 8. At the lower end, these two support and guiding rods 74 are fitted with a small contact disk or roller 75 engaging against the governing surface 76 of a fourth cam 77, which is fastened by suitable means, such as a cotter pin, to the same driven shaft 48 as is the third cam 47, which governs the ascending and descending motions of the lower welding jaw 8. The two cams 47 and 77 have their governing or driving surfaces 76 angularly shifted, so that when the blocking shoe 71 descends to the tightening position (FIGS. 4 and 7) against the downstream end portion of sheath 2 not yet welded and cut, the lower jaw 8 already is in the low welding position (FIGS. 3 and 6). In addition, the positions of these third and fourth cams 47 and 77 are synchronized with those of the first and second cams 25 and 31, so that the sheath 2 will be retained by the braking roller 38 (FIG. 1) at the time of the upward spacing or pivoting of upper transporting roller 7, and at the time of tightening of the downstream end portion of sheath 2 by the blocking shoe 71.

Blocking shoe 71 is in the shape of a right angle beam member having the horizontal lower leg 71*a* extending in an upstream direction toward the welding jaws 8, 9, at a relatively low height. The horizontal leg 71*a* constitutes the blocking shoe per se. The upright vertical leg 71*b* of the angle member 71 serves as support for the grooved guiding bar member 57 which guides the lower smooth side of the timing belt 61 and knife 56 along the cutting path run. The grooved guiding bar 57 is affixed to the vertical leg 71*b* in a manner such that the horizontal guiding groove 57*a* opens downwardly, in the direction of the horizontal leg 71*a*. In that way, the lower side of the timing belt 61, the horizontal knife or blade 56 and the knife mounting tab 62 fixing the knife to the belt 61 are shielded against any accidental entry of foreign objects.

It must be noted that blocking shoe 71 is placed in a manner such that the vertical path of upstream facing vertical face 71*a*' of the horizontal leg 71*a* passes in close proximity to the downstream facing vertical counter-blade face 54*a*, 55*a* of the shoulder 54 and of groove 55 therein and will be longitudinally separated from the vertical counter-blade face 54a, 55a by a distance equal to a few thicknesses of the flattened sheath 2, for example two to five double thicknesses of the flattened sheath.

The tip of knife of blade 56 extends in an upstream direction slightly beyond the vertical face 71a' of the horizontal leg 71a of the blocking shoe 71 when the knife 56 engages into the groove 55. The main function of the blocking shoe 71 is in holding and clamping the upstream end of sheath 2 against the damping pad 67c of stacking table 67 or against one or more bags in process of forming a stack 14, and to bring the portion of the sheath extending from the transverse upper edge 54a of the vertical face of shoulder 54, to the vertical face 71a' of the leg 71a in a generally vertical position against the upper edge 55a of groove 55 which serves as counter-blade, in which the general vertically extending portion is horizontally cut by the knife 56 passing in the counter-blade groove 55. In addition to shielding against any accidental entry of foreign objects to knife 56 on the lower side of belt 61, it provides elastic support for the guidance and of governing of the upper jaw 9 which is movable in unison with the blocking shoe 71 and also relatively movable to the blocking shoe 71.

Figure 5:
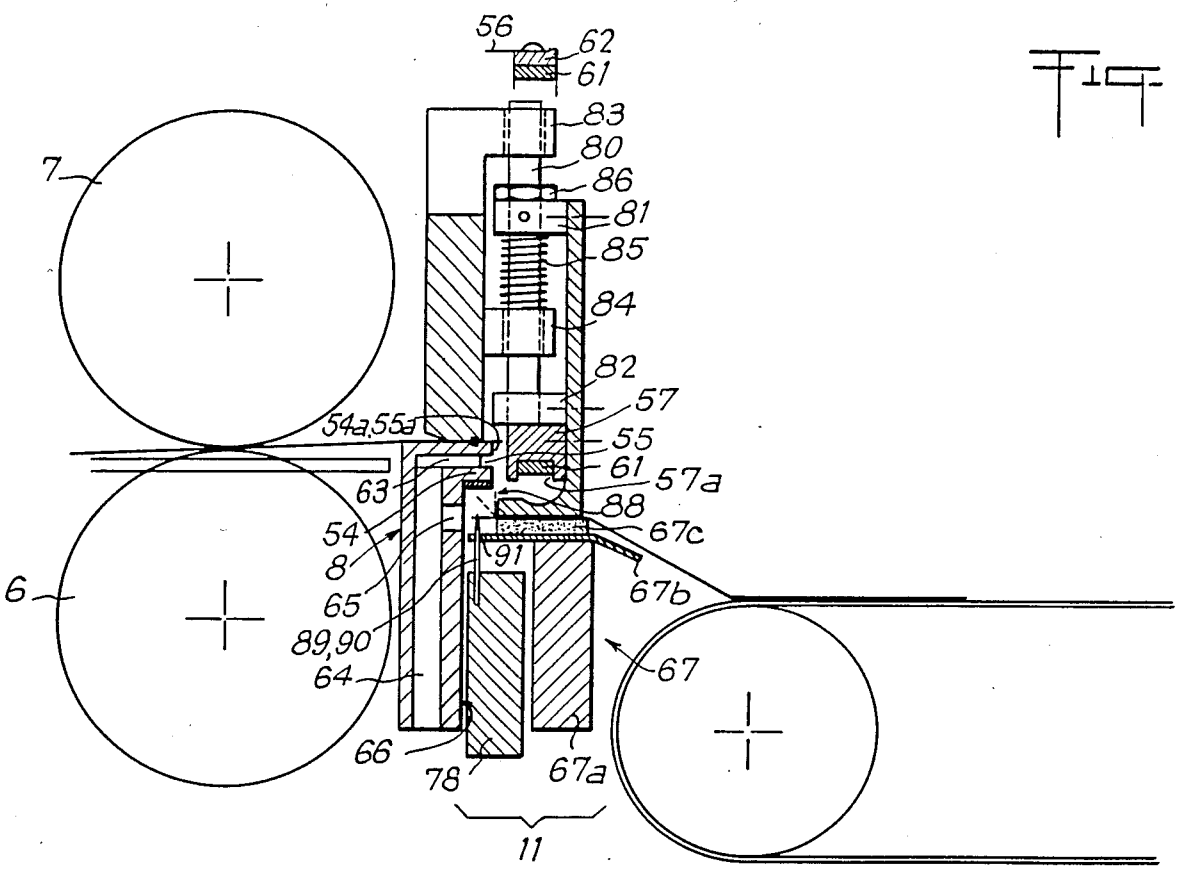

According to the invention, with reference to FIGS. 3–5, two vertical guiding columns 80 are fixed laterally and above the horizontal leg 71a and the grooved timing belt guiding bar member 57 mounted to the vertical leg 71b of the blocking shoe 71 by means of upper and lower collets 81 and 82, both of which are fixed in place to the vertical leg 71b on the upstream facing side. The upper end of the two vertical columns 80 projects above the upper end of the upper collet 81 by a distance equal to at least one-half of the vertical distance between the two superposed upper and lower collets 81 and 82. The vertical downstream facing face of the upper jaw 9 is fitted with two superposed upper and lower guiding bearings 83 and 84 having vertically and axially aligned bores which are co-axial with the vertical axes of the guiding columns 80. The upper and lower portions of the guiding columns 80 are slidably mounted in the guiding bearings 83, 82. A compression spring 85 is sleeved over each guiding column 80 between the facing horizontal sides of the upper collet 81 and the lower guide bearing 84. The upper and lower collets 81, 82 are disposed below the downward facing horizontal sides of the upper and lower guiding bearings 83, 84, so that compressive force of the spring 85 continuously urges the upper jaw 9 in a downwardly direction and the blocking shoe in an upwardly direction. Between the upper horizontal face of the collet 81 and the lower horizontal face of the upper guiding bearing 83, an adjustment means is provided for adjusting the compressive force of the spring 85, comprising a nut 86 threaded to a threaded upper portion of the guiding column 80 and seated against the upper horizontal side of the upper collet 81, and which serves to regulate the vertical spacing between the welding face side of the upper jaw 9 and the sheath facing face of the horizontal leg 71a of blocking shoe 71 and to raise the upper jaw 9 during the rising run of the blocking shoe 71.

It is to be understood that according to the invention during the descending run of blocking shoe 71, the upper jaw 9 is pressed against the lower jaw 8 in the low welding position before the blocking shoe 71 descends and compresses the upstream portion of sheath 2 against the damping pad 67c of the stacking table 67 or against the stack of bags 14 stacked on the stacking table 67. It is further to be understood that, by means of the regulating nut 86 and of its vertical distance relative to the lower sheath facing face of blocking shoe 71, it is possible to adjust the force with which the upper jaw 9 is pressed against the lower jaw 8 at the time of welding, under the action of the compression spring 85. The upper jaw 9 has a transverse welding line 87 on the lower sheath facing face cooperating with the transverse welding line 53 on the upper sheath facing side of the lower jaw 8 in the same vertical plane as the latter. The transverse welding lines 87 and 53 comprise electric resistance wires 87, 53.

According to the invention, during the descending displacement of blocking shoe 71, sheath 2 is first welded by the upper jaw 9 descending to the lower jaw 8 to the low position and pressing the sheath therebetween on the welding lines 87, 53 before blocking shoe 71 descends and presses the upstream portion of sheath 2 against damping pad 67c or against the pile of bags 14 stacked on the pad 67c and tensions and flexes the portion of sheath projecting downstream from the clamped jaws 9, 8 into an aproximately vertical position into close proximity with the edge of the cutting groove 55 in front of which the flexed sheath end is cut by the knife 56, which partially engages the edge of the groove, as it enters into the groove opening in one lateral side of the shoulder and rapidly passes through the groove (FIGS. 4 and 7) and exits through the other groove opening in the other lateral side. As soon as knife 56 has left cutting groove 55, the lower jaw 8 is raised upward into a high so-called clearing position (FIG. 5) in which the underside face of the retaining shoulder 54 is raised slightly above the cut upstream end 88 of the bag which has just been cut and which is still is clamped against the pile of bags 14 or against damping pad 67c of the stacking table 67. In this high position of lower jaw 8, the short, upstream cut end 88 of the cut bag, the length of which is approximately in order of 5 to 10 mm, automatically rapidly folds back from the substantially vertical position under the effect of its stiffness or of its "memory" (FIG. 5). The flattening or the folding down of the cut free upstream end segment 88 of the last cut bag may be helped by the second air layer coming out of the blowing apertures 63 and opening into cutting groove 55 or by the apertures 65 below the latter on the vertical downstream facing face 54a of retaining shoulder 54. As soon as the end of sheath 2 downstream of the jaws 9, 8 is cut, and the lower jaw 8 has returned to the high position, a portion of the air layer will be sent downward into the space existing underneath the lower face of the retaining shoulder 54 and the lower leg 71a of the blocking shoe 71 before being aspired into the manifold chamber 64, by transverse ducts 65, and recycled back through the blowing apertures 63 (FIG. 5). The transverse ducts 65 in the high position of the lower jaw 8 are located at the level of, or slightly below, the lower sheath facing face of blocking shoe 71 in the clamping and tensioning position.

Because blocking shoe 71 remains in the low clamping position during the short ascending run of lower jaw 8, a run which depends on the length of the upstream cut end segments 88 of the stacked bags 14 and is for example approximately in the order of 8 to 15 mm, the upper jaw 9 is driven into the described ascending run against the resistance of the compression spring 85 (FIG. 5) and it moves back down with the lower jaw 8 into the low position as soon as the upstream cut end segment 88 of the last cut bag has been folded down into the horizontal position.

The upstream cut end portion 88 of each cut bag is folded down against a transverse row of needles or pins 89 which extend parallel to the counter-blade cutting groove 55, underneath the retaining shoulder 54. The row of needles 89, for example, is positioned on a transverse vertical plane passing through the transverse vertical bottom wall of the horizontal groove 55. The row of needles 89 is fixed to the vertically movable pin carrier 78 described above, and positioned in a fixed location, during the entire bag stacking operation, between the lower jaw 8 and the support cross beam **67*a* of the stacking table 67 and extending upward from beneath the upstream end portion, slightly out of plumb, of support plate 67*b* of said table 67**.

The transverse row 89 of vertical needles or pins 90 pass through a transverse row of vertically aligned pin passage holes 91 made in the upstream extending end of support plate **67*b* the terminal end of which extends underneath the retaining shoulder 54 and terminates in the immediate proximity of the vertical downstream facing face 66 of the lower jaw 8. The sharpened tips of the vertical needles or pins 90 are positioned along a horizontal plane which is located slightly above the upper face of damping pad 67*c* or above the stack of bags 14 in the process of formation. The needle tips slightly engage in a resilient pad or insertion shoe 92 affixed to the underside of retaining shoulder 54 and which constitutes a horizontal downward facing lower face of the shoulder 54. As soon as the upstream cut end segment 88 of a bag has folded down on the tips of needles or pins 90, the lower jaw 9 moves down from the high position of FIG. 5 to the low position of FIG. 3 and impales that end segment 88 on the tips by means of the transversely extending insertion shoe or pad 92 while pressing the cut end of the other stacked bags 14 downwardly by a height equal to the thickness of the last cut bag, those other bags having first been impaled over the needles or pins 90 by the shoe or pad 92**.

It should be noted that the impaled cut upstream ends of all of the stacked bags overlap and are not supported by the damping pad **67*c* of the stacking table 67. Thus the impaled cut ends 88 cannot be compressed or tightened by the horizontal underside of the shoulder 54, or more precisely by the insertion shoe 92 mounted thereto, which presents a certain amount of elasticity, and which urges the ends vertically downward over the pins toward the upstream facing terminal end of support plate 67*b* which is provided with the transversely extending row of pin passage holes 91 vertically aligned with the pins 90 and spaced upstream from the upstream facing vertical face 67*c*' of the damping pad 67*c***.

When lower jaw 8 accompanied by upper jaw 9, under the compressive force of spring 85, has thus returned to the low position to await the next welding operation following the downward run, which at the same time serves to impale the upstream folded back end 88 of the last cut bag onto the tips of needles or pins 90, the blocking shoe 71 returns to the high position shown in FIG. 3, lifting along with it the upper jaw 9, in order to free the forward trajectory of the welded downstream end of sheath 2 which, under the action of the two transporting rollers 6, 7, is carried by the layer or layers of blown air coming from the blowing tubes 18 and from the blowing orifices 63 and, is moved forward by a step corresponding to the length of a bag. It is to be noted in FIG. 3 that the tips of needles or pins 90 then are in contact with the pad 92 and are rendered inaccessible and in no case can damage the sheath 2 during the forward trajectory motion to the transport belt 13.

In the stopping mechanism 60 (FIG. 9), which permits the progressive step-by-step descending displacement of the stacking table 67, a compression spring 93 continuously prevents any inadvertent ascending displacement of the stacking table 67 as soon as the ascending run is begun and exceeds a pre-set step length of 1 to 2 mm for example. The operation of the stopping mechanism 60 will now be explained.

A vertical slider member 58 is provided for on each lateral vertical end face of the support cross beam **67*a* of the stacking table 67, and it comprises an upper shoulder 58*a* and a lower extension 58*b* which projects below the lower downward facing face of support cross beam 67*a* and is mounted for vertical sliding inside a guiding grove 59*a* in a larger vertical guide member 59 which, at its upper part, is articulated by means of a horizontal pivot pin 79 mounted on the downstream facing vertical face at the lateral opposite ends of the needle or pin carrier 78 in a manner such that it can pivot slightly, from the vertical upright position, in a vertical plane parallel to the vertical downstream facing face of the needle or pin carrier 78. At the upper end of the pivotable guide member 59 above the pivot 79, a stop lug piece 59*b* is provided which caps the upper end of the guiding groove 59*a* and is capablee of cooperating with upper shoulder 58*a* on the smaller slider 58 in order to limit the ascending run of the stacking table 67 in the high position, relative to needle or pin carrier 78, when the stopping mechanism is rendered inoperative, in the manner which will be explained below, to a position in which the needles or pins 90 are disengaged or released from the stack of bags 14 and in which the tip of needles 90 is vertically moved below the level of the upper face of damping pad 67*c* and preferably below the upper openings of the pin passage holes 91 in the support plate 67*b* of the stacking table 67**.

The vertical lateral face of vertical slider 58 of the stacking table 67 faces the bottom of the guiding groove **59*a* and is equipped, at least in the lower portion 58*b*, with a series of superposed ratchet teeth and notches 94 one of which at least is cooperating with a pawl 95 seated in a chamber 59*c* which opens into the lower portion of the guiding groove 59*a* in a manner such that the tooth 95*a* of the pawl can become engaged in the space or notch between two neighboring ratchet teeth 94. The pawl 95 engages with the lower ratchet teeth notch in order to prevent any ascending motion of the stacking table 67 whenever the run of which exceeds the spacing between two successive ratchet teeth notches, while permitting the downward motion of the stacking table 67 relative to needle or pin carrier 78. The shape of the ratchet teeth 94, for example, is similar to the teeth of a saw having a horizontal side and a side slanted from the top down, from the outside toward the inside of the interval which separates two successive notches and the tooth 95*a* of stop catch 95 which projects into the guiding groove 59*a* and presents a corresponding cooperating shape with a horizontal lower face and an upper face, which is slanted from top to bottom, from the upper face of a hollow chamber 59*c* formed in the pivotable guide 59, from the guiding groove 59*c* of the latter and which serves as seat for the stopping pawl catch 95. Tooth 95*a* of stopping catch 95 is biased in the direction of the stopping ratchet teeth and notches 94 and is maintained engaged in an interval between two successive notches 94 under the action of a compression spring 96 which presses on one side against the lower part of the pivotable guide 59 and presses on the other side against a counter-lug piece 97 fixed to the downstream facing vertical face at the lateral opposite ends of the needle or pin carrier 78. In that way, the stopping catch 95 is constantly urged to the position of engagement with the stopping ratchet teeth and notches 94. Because of the vertical location of the locking spring 96 at a point remote from pivot 79, it is possible to achieve a suitable locking force for the catch 95, which is between the pivot 79 and spring 96**, with a relatively small spring force.

The vertical slider member 98 at each lateral end of the needle or pin carrier 78 engages inside a vertical guiding groove 99*a* of a fixed in place guide 99 mounted, for example, to the guiding casing housing 45 mounted on the frame 1. At the upper part, the slider 98 of the needle or pin carrier 78 is provided with a cutout section 100, the horizontal internal face of which 100*a* forms an upper end of the slider portion engaged in the guiding groove 99*a* and constitutes a lug piece cooperating with a counter-lug piece 99*b* which closes and caps the upper end of the guiding groove 99*a*. The counter-lug piece 99*b* is of fixed in place to the guide 99 and limits the high position of the transverse row of needles 89, 90 when the needle or pin carrier 78 is in the high position shown in FIG. 3 and 6.

Needles or pins 90, of needle or pin carrier 78, occupy a fixed elevational position during the cycle of production of a complete stack of bags 14, and must be removed from the upstream end of the stacked bags in order to permit the transfer and removal of that stack of bags 14 by the endless transporting belt 13. In addition, at the end of a cycle of manufacture of a completed stack of bags 14, the stacking table 67 has progressively reached a low position (FIG. 7) relative to the needle or pin carrier 78 and must be brought back to the high position (FIG. 3) relative to needle or pin carrier 78, which corresponds to the start of a new bag stacking cycle and in which the notched upper shoulder 58*a* of the slider member 58 of the stacking table 67 abuts against the stopping lug piece 59*b* of the pivotable guide member 59. The total length of the needle portion, which projects upwardly from the holes 91 in the upper horizontal face, takes into account the maximum height of a completed stack of bags 14, the thickness of the support plate 67*b* of stacking table 67, as well as the height of the needle which projects upward from the cross beam 78 to the underside of the support plate 67*b*. The height is capable of varying by a value equal to at most to the spacing between two successive ratchet teeth notches 94 and being approximately equal to the thickness of the damping pad 67*c* in the non-compressed state. In other words, the maximum spacing between the lower face of support plate 67*b* and the upper face of needle or pin carrier 78 is at least equal to the maximum height of a completed stack of bags 14.

Figure 7:
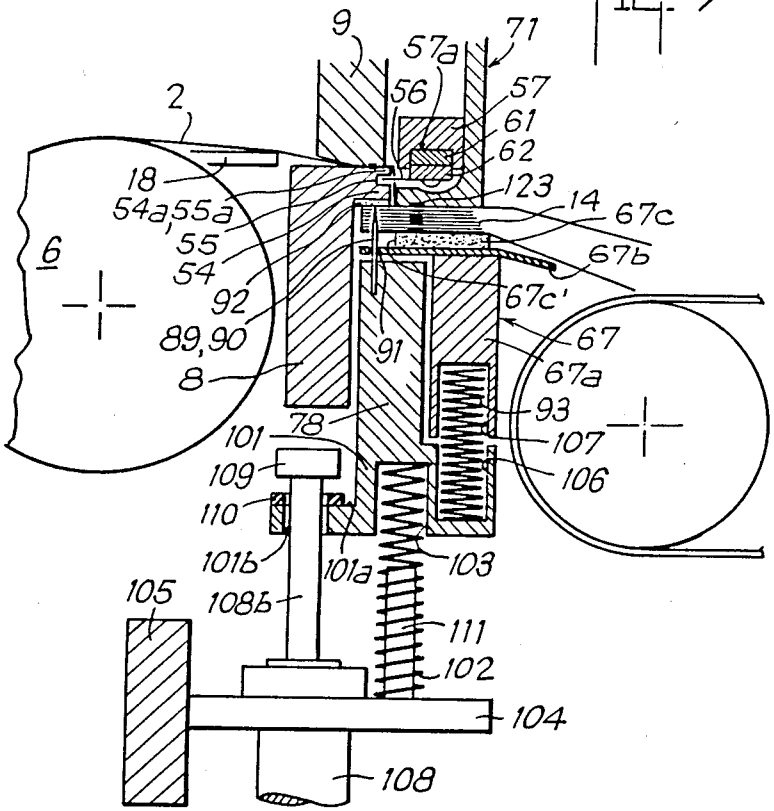

In order to make it possible for the removal of the needles or pins 90 out from the stack of bags 14 after the completion of the stack FIG. 7, the needle or pin carrier 78 rests on an intermediary vertically movable support member 101 which is fixed to the lower side of the needle or pin carrier 78 and is slidably mounted to frame 1 so that it can be brought back from a high position which corresponds to the high insertion position of the needles or pins 90 (FIG. 7), to a low position (FIG. 8) in which the tip of needles or pins 90 is located below the horizontal plane of the upper facing face of damping pad 67*c* and preferably below the opening of the corresponding holes 91 in the support plate 67*b* of the stacking table 67. To that end, the intermediary support structure 101 sits on top of a compression spring 102 which has an upper portion nested in a guiding cup 103 opening downwardly and has a lower portion sleeved over a vertical upright rod 111 having a lower end fixed to a horizontal base plate 104 which is fixed to a transverse beam 105 affixed to frame 1. The movable intermediary support structure 101 carries a second guiding cup 106 opening upwardly and mounted to a vertical downstream facing side of the structure 101. This cup 106 receives the lower end of a compression spring 93 which has the upper end nested in a bottom opening cup 107 provided in the bottom of the cross beam 67*a* supporting the stacking table 67. A vertically extendable jack unit 108 has a power cylinder 108*a* fixed at the upper end to the base plate 104. A movable power jack rod 108*b* extends through a hole 101*b* in a horizontal flange 101*a* on the carrier 78. A driving lug piece 109 is fixed on the free end of the jack rod 108*b*, and acts against the compression spring 102 in the downward direction for the lowering of the needle or pin carrier 78. The flanged shoulder 101*a* is fixed to the vertical upstream facing face of the movable intermediary support 101. The upper end of the jack rod 108*b* runs through the bore 101*b* provided in the flanged shoulder 101*a*. The driving lug piece 109 on the jack rod 108*b* is lowered against the upper face of the shoulder 101*a* and comes into contact with a damping washer 110 encircling the jack rod 108*b*. The vertical spring supporting rod 111 is affixed to the upper face of base plate 104 and is coaxially aligned with the guiding cup 103 and telescopes into the lower part of the compression spring 102. The upper terminal end of the rod 111 limits the descending run of the intermediary support 101 and of needle or pin carrier 78. The ascending run of needle or pin carrier 78 is adjustable and it is limited by means of another vertical lug-rod 112 (FIG. 9) the upper end of which is threaded into a vertical threaded bore 113 in the underside of needle or pin carrier cross bar 78 and is locked in place by means of a locknut 114. A threaded lower portion runs through a hole 115 provided for in the base plate 104 for the free passage of the rod 112. The rod 112 is fitted belew the plate 104 with a damping washer 116 and with two locknuts 117, 118. The high insertion position of the pins 90 and the ascending run of the needle carrier 73 is determined by adjusting the compressive force of the spring 93 by adjusting the length of the lug-rod 112 connected beneath the support plate 104.

The stopping mechanism 60 of the stacking table 67 is associated with a releasing device 119 which, at the end of the descending run under the action by the releasing jack 108, temporarily releases the stacking table 67 from its connection with needle or pin carrier 78 and allows it to return into the high position, also relative to needle or pin carrier 78 (FIG. 8), a high position in which the tips of needles 90 are disengaged from stack of bags 14 which then is approximately at the level of the upper side of the endless transporting belt 13 and can easily be removed by the latter.

That release device 119 comprises a small control disk or roller 120 mounted in place to a horizontal support-rod 121 fixed to the lower part of a transverse beam 105. An angled control ramp 122 is provided on the lower terminal free end of the pivotable guide 59, which, because of its articulation on pivot 79 acts here as a lever activated whenever the small control disk or roller 120 comes in contact first with ramp 122 then with the straight lower portion of the upstream facing vertical face of the pivotable guide 59 so that the stopping catch 95 will be released from the ratchet notches 94 against the action of compression spring 96, and so that the stacking table 67 can move back up to the high position relative to the needle or pin carrier 78, a high position which is determined by the coming into contact of upper shoulder 58*a* of slider 58 of table 67 with the stopping lug-piece of the pivotable guide 59 articulated on the needle or pin carrier 78, which is still located in its low position (FIG. 8).

When needle or pin carrier 78 is also made to return up to the high position as shown for example in FIGS. 6, 7, the stacking table 67 returns up at the same time and as soon at the control ramp 122 is disengaged from the fixed small control disk or roller 120, stopping mechanism 60 reestablishes the connection between needle or pin carrier 78 and the stacking table 67 so as to prevent any return up motion of the table over a run exceeding the distance between two stopping ratchet notches 94. Table 67 then again can move downward progressively relative to needle or pin carrier 78 to take into account the increasing height of the stack of bags 14 without being able to move back up beyond one notch 94 for the purpose of following the reascending motion of blocking shoe 71.

In accordance with another embodiment of the present invention, the bag making machine provides a stack welding means 123 (FIG. 7) to join, that is to say, to connect the cut bags together into a stack 14 as each bag is deposited on the top bag of the pile. The welding means 123 is provided on the underside of the upstream facing end of the horizontal leg 71*a* of the blocking shoe 71. In this arrangement the addition of heat is prevented to the upstream projecting free ends of the cut bags pressed under retaining shoulder 54 of lower jaw 8, which might create rising hot air currents that would oppose the folding back of the substantially vertical upstream end segment 88 of the cut bag.

The operation of the bottom seal bag making machine is well known in the art so that no elaborate and detailed description was given above. Certain modification may be made in the described practice of the invention without departing from the scope of the protection defined by the attached claims.

What is claimed is:

1. A machine for the manufacture and stacking of bags, pouches and the like made from a flattened sheath of thermoplastic material, the machine of the type generally comprising upper and lower sheath transporting roller means intermittently driven for intermittently advancing the sheath between upper and lower welding jaw means intermittently opening and closing in timed relation to the intermittently advancing sheath for advancing the sheath having a welded closed end by a bag length to a stacking table in the jaw open position and for welding the advanced welded closed end sheath deposited on the stacking table in the jaw closed position for the start of a second welded closed end, clamping means for clamping the deposited welded closed end sheath to the stacking table and for flexing and tensioning a segment of the clamped sheath extending from the closed jaws to the clamping means prior to cutting by an intermittently driven knife means mounted on an endless timing belt, the knife means activated in timed relation to the closing of the jaws and the clamping of the sheath to the stacking tablee and when activated the knife means passing crosswise through the segment for cutting and forming an open ended bag with the welded closed end supported on the stacking table, pin means for impaling the cut segment of the formed bag thereon and for forming a uniform stack of bags on the stacking table, means for unpinning the stack of bags after a predetermined number of bags have been pinned and uniformly stacked on the stacking table, and conveyor means for removing the unpinned uniform stack of bags from the stacking table for the start of a new stack of pinned bags, wherein the improvement comprises:

a braking means (5) upstream of the upper and lower roller means (7,6) for intermittently halting the advancing sheath in timed relation to the roller means intermittently stopping the advancement of the sheath to the upper and lower jaws (9,8) concurrent with the jaws closing on the sheath and forming the welded closed end of the bag; and wherein, the lower welding jaw (8) is slidably mounted to the machine (45, 44) for vertical movement from a set low position to a set high position and the upper welding jaw (9) is slidably mounted by a lost motion connection (80, 81, 82, 85) to the clamping means (71) for vertical downward movement therewith from a set raised position to the low position and for vertical upward movement through the lost motion connection to the high position under the action of the lower jaw independent of the clamping means; and, the clamping means is slidably mounted to the machine (74, 45) for vertical movement from a set raised position above the level of the upper welding jaw in the open position to a set lowered position below the level of the lower welding jaw in both the low and high positions thereof, and the lower jaw having a shoulder means (53) extending toward the clamping means (71) for holding fast the segment (88) of the sheath to be cut in the closed condition of the jaws in both the low and high positions of the lower jaw, the shoulder means having a resilient transversely extending pin engaging pad (92) mounted to a horizontal projecting underside (54) thereof, and having a transversely extending horizontal groove (55) forming a counter blade for the knife means (56) mounted on the timing belt (61), and the clamping means having a belt guiding means (57) for positioning the knife means for entry into the counter blade groove in the low position of the lower jaw and in the set lowered position of the clamping means and for guiding the knife means in a horizontal path through the counter blade groove and cutting the segment of the sheath; and wherein, the pin means (90) is mounted to a carrier (78) slidably mounted to the machine (98, 99, 45) for vertical movement from a set raised position where the pin means pass through holes (91) in the stacking table (67b) and engage with the resilient pad mounted to the underside of the shoulder of the lower jaw means to a set lowered position where the pin means is below the stacking table, and the stacking table is resiliently connected by biasing means (93) to the pin carrier and is slidably connected to the pin carrier by a ratchet and pawl means (60) for incremently lowering the stacking table independently of the pin carrier by the action of the clamping means clamping the successive sheaths deposited on a resilient transversely extending sheath receiving pad (67c) mounted to the top of the stacking table which is vertically aligned with the clamping means and is longitudinally spaced from the underside of the shoulder on the lower jaw and from the holes in the stacking table so that the pin engaging pad on the underside of the shoulder rests on the tips of the pin means in the low position of the lower jaw without exerting any pressure thereon and the immediate cut segment unflexed under the shoulder in the high position of the lower jaw is deposited on the tips of the pin means in the set raised position of the pin means.

2. The machine according to claim 1, wherein the pin carrier is further resiliently connected by a second biasing means (102) to the machine (111, 104) and to a jack means (108) by a lost motion connection (110, 101*b*), the jack means having a cylinder body (108) mounted to the machine (104, 105) and having a vertically movable rod means (108b, 109) extending from the body and slidable mounted to the lost motion connection for lowering the pin means to the set lowered position when retracting into the body and for disengaging the pawl and ratchet means in the set lowered position of the pin carrier when retracted to a set maximum limit thereby permitting the biasing means connecting the stacking tablee to the pin carrier to raise the stacking table above the pin means for unpinning the stack of bags, the second biasing means raising the pin carrier to the set raised position and raising the stacking table to a starting position following expansion of the rod means through the lost motion connection.

3. The machine according to claim 2, wherein the pawl and ratchet means comprise a depending ratchet member (58) having ratchet teeth and notches in the lower end thereof and mounted at the upper end to the stacking table (67) and slidably mounted in a vertical groove (59*a*) in a depending pawl member (59) pivotally mounted by a pin 79 at the upper end to the pin carrier and having a pawl element (95) carried in a chamber (59*c*) spaced above the lower end of which is provided with a cam means (122) for engagment with a roller (120) carried on the machine (105) in the set lowered position of the pin carrier for rocking the pawl member about the pin and disengaging the pawl element from the ratchet teeth.

4. The machine according to claim 3, wherein the biasing means resiliently connecting the stacking table to the pin carrier comprises a first compression spring (93) nested at an upper end in a downwardly opening cup (107) carried on the underside (67*a*) of the stacking table and nested at a lower end in an upwardly opening cup (106) carried on the underside (103) of the pin carrier.

5. The machine according to claim 4, wherein the second biasing means comprises a second compression spring (102) having an upper end nested in a downwardly opening cup (103) carried on the underside of the pin carrier and having the lower end sleeved over a vertical stop rod means (111) mounted to the machine for setting the lowered position of the stacking table and the pin carrier.

6. The machine according to claim 5, wherein the lost motion connection means between the clamping means and the upper jaw comprise a first pair of vertically spaced upper and lower collars (81, 82) mounted to an upright arm (71*b*) of the clamping means, an elongated rod member (80) fixed at the lower end to the lower collar and projecting upwardly through the upper collar for a distance greater than the set upper position of the upper jaw, a second pair of upper and lower collars (83, 84) mounted to the upper jaw with the lower collar slidably mounted to the rod member between the upper and lower collars on the upright arm and the upper collar on the upper jaw slidably mounted to the projecting end of the rod member, and a compression spring means (85) sleeved over the rod member between the lower collar on the upper jaw and the upper collar on the upright arm for permitting the raising of the upper jaw by the action of the lower jaw to the high position of the lower jaw and for returning the upper jaw to the set raised position upon raising of the clamping means to the set raised position.

7. The machine according to claim 2, further including a second lost motion connection means (117, 115) between the pin carrier and the machine (104) for fixing the set, raised position of the pin carrier following expansion of the rod means through the first mentioned lost motion connection.

8. The machine according to claim 6, wherein the braking means comprise a roller (38) mounted on a shaft carried on an end of a lever arm (37) pivotally mounted to the machine (1) upstream of the upper and lower transport roller means, the lever arm connected by a breakaway connection (43, 42) to a pivotable arm (21*b*) of a lever means (21) for moving the upper transport roller means (7) from the lower transport roller means (6), the breakaway connection comprising an adjustment screw mounted on the lever arm and a contact bar mounted on the pivotable arm and including a compression spring means (40) having an upper end engaging the machine (41) and a lower end engaging the lever arm for urging the adjustment screw into engagment with the contact bar upon pivotal movement of the lever means lowering the upper transport roller means and for pivoting the roller downwardly against a brake shoe (39) fixed to the machine upon pivotal movement of the lever means raising the upper transport roller means.

9. The machine according to claim 7, wherein a bag stacking welding means (123) is provided on the clamping means (71*a*) for joining the facing surfaces of adjacent stacked bags together.

10. The machine according to claim 7, wherein the lower welding jaw includes a first transversely extending horizontal beam member (8), the stacking table includes a second transversely extending horizontal beam member (67*a*) and the pin carrier includes a third transversely extending beam member (78) positioned between the first and second beam members, the third beam member having upstream and downstream extending shoulder members (101*a*, 101), the upstream shoulder member having a bore (101*b*) slidably mounting a headed end (109) of the rod means, the headed end engageable with a resilient washer (110) sleeved over the rod means (108*b*) between the headed end and an upperside of the upstream shoulder member, the downstream shoulder member having the upwardly opening cup (106) for the first compression spring (93) mounted thereto, and the underside of the third beam member between the upstream and downstream shoulder members having the downwardly opening cup (103) for the second compression spring (102) mounted thereto.

* * * * *